US005135183A

United States Patent [19]

Whitney

[11] Patent Number: 5,135,183

[45] Date of Patent: Aug. 4, 1992

[54] DUAL-IMAGE OPTOELECTRONIC IMAGING APPARATUS INCLUDING BIREFRINGENT PRISM ARRANGEMENT

[75] Inventor: Colin G. Whitney, Agoura Hills, Calif.

[73] Assignee: Hughes Aircraft Company, Los Angeles, Calif.

[21] Appl. No.: 764,275

[22] Filed: Sep. 23, 1991

[51] Int. Cl.[5] ..... F41G 7/26

[52] U.S. Cl. ..... 244/3.16

[58] Field of Search ..... 244/3.16

[56] References Cited

U.S. PATENT DOCUMENTS

| | | | |
|---|---|---|---|
| 3,296,443 | 1/1967 | Argyle | 244/3.16 |
| 4,028,544 | 6/1977 | Jourdan et al. | 244/3.16 |
| 4,030,686 | 6/1977 | Buchman | 244/3.16 |

*Primary Examiner*—Charles T. Jordan
*Attorney, Agent, or Firm*—R. M. Heald; C. D. Brown; W. K. Denson-Low

[57] ABSTRACT

A birefringent prism (36) is disposed in front of the entrance aperture (26*a*) of a Cassegrain-type telescope (26) which constitutes the optical focussing assembly in a tracking system for a guided missile (10) or the like. The prism (36) refracts first radiation (O) having a first polarization in a first direction, and refracts second radiation (E) having a second polarization which is orthogonal to the first polarization in a second direction which is deviated from the first direction by a predetermined angle $\Delta\phi$. The telescope (26) focusses the first and second radiation (O,E) to form separate, laterally displaced first and second optical images (46,50) on first and second respective sections (34*a*,34*b*) of a focal plane photodetector array (34). Polarizing filters (56,58) which pass only the first and second polarizations therethrough are disposed in front of the respective sections (34*a*,34*b*) of the photodetector array (34) to eliminate optical crosstalk between the two images (46,50). Optical bandpass filters (54,52) having different wavelength passbands may also be provided in front of the two sections (34*a*,34*b*) of the photodetector array (34) such that the two images (46,50) constitute different color images of the scene (16).

36 Claims, 4 Drawing Sheets

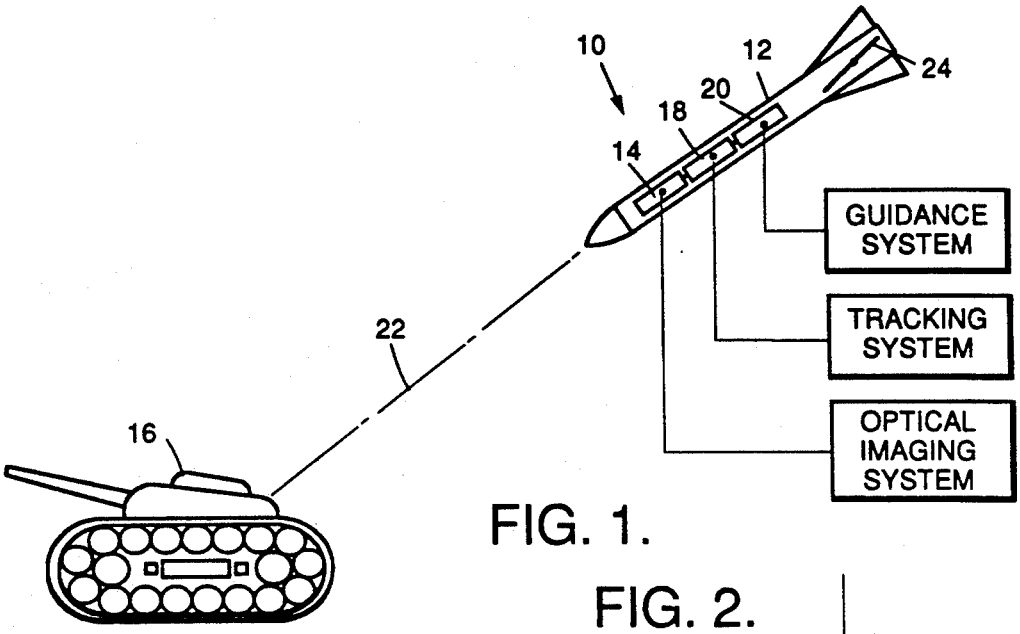
FIG. 1.
FIG. 2.
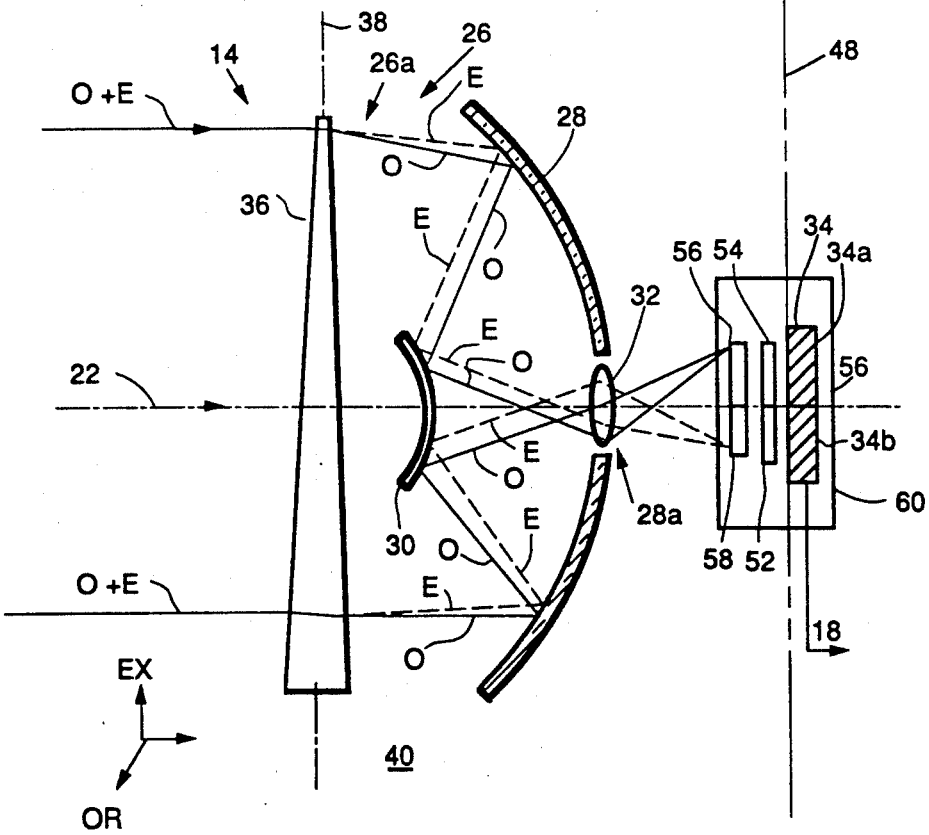

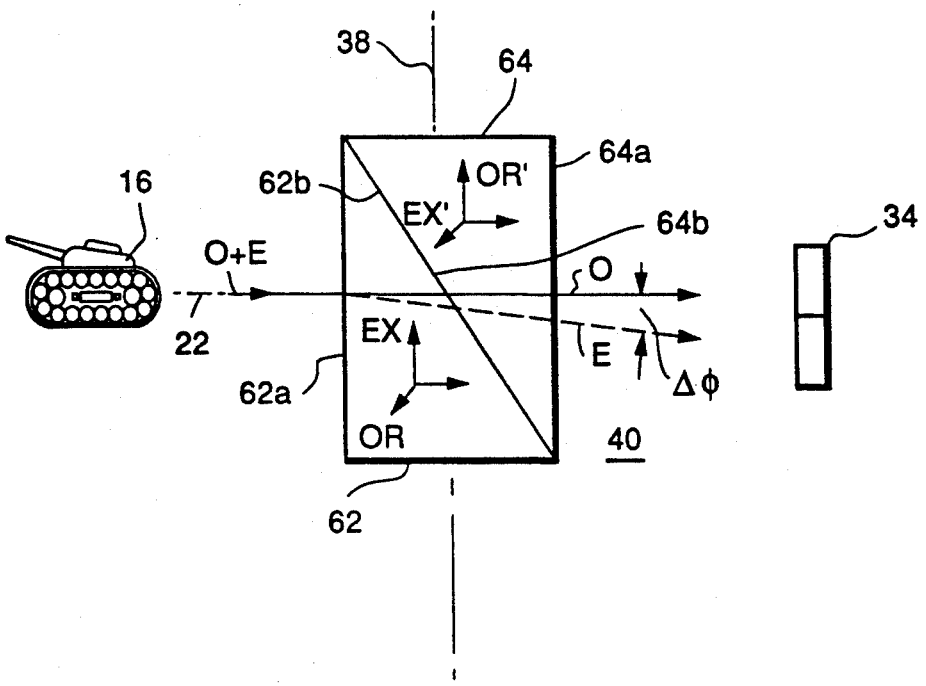
FIG. 5.
FIG. 6.
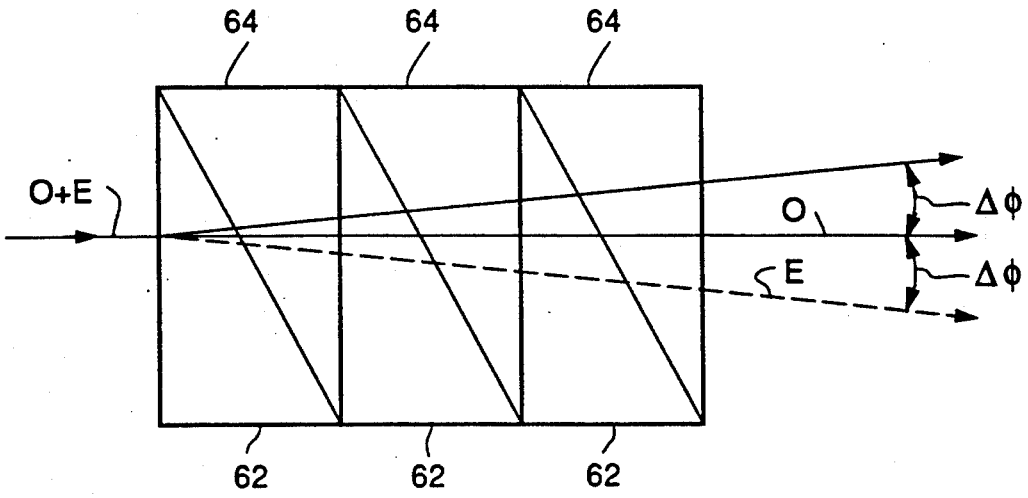

DUAL-IMAGE OPTOELECTRONIC IMAGING APPARATUS INCLUDING BIREFRINGENT PRISM ARRANGEMENT

BACKGROUND OF THE INVENTION

1. Field of the Invention

The present invention generally relates to the field of optoelectronic imaging devices, and more specifically to an optoelectronic imaging apparatus for a guided missile tracking system, forward looking infrared system or the like which produces two simultaneous images of a scene or target in different spectral bands using orthogonal polarizations.

2. Description of the Related Art

Optoelectronic imaging systems for guided missile tracking and the like are generally of the scanning or staring type. Mechanical scanning systems use motor drives to move mirrors or other scanning elements to scan a scene and sequentially focus optical images of incremental portions of the scene on a linear photodetector array. Electrical signals generated by the array are combined to construct a composite electronic image of the scene. A typical example of a scanning type optoelectronic imaging system is disclosed in "Thermal Imaging System", by J. Lloyd, Plenum Press, 1979, pp. 324–351.

Mechanical scanning systems are limited in speed, due to the inherently slow motor drives and in sensitivity due to the limited number of detectors used. For this reason, "staring" optoelectronic imaging systems have been developed in which an image of the entire scene is focussed by a Cassegrain telescope or other type of optical imaging assembly onto a rectangular focal plane photodetector array. The imaging system continuously "stares at" the entire scene, rather than scanning it. A composite image of the scene is produced by electrically scanning the photodetector elements of the array, which can be much faster than mechanical scanning. An exemplary staring type optoelectronic imaging system is disclosed in "AIR INTERCEPT IMAGING INFRARED SEEKER", by James A. Bailey, Proceedings of the Infrared Information Symposium, January, 1991, Vol. 35, No. 1, pp. 201–215.

Regardless of type, conventional optoelectronic imaging systems are designed to be sensitive to electromagnetic radiation in one optical wavelength band, for example visible light having a wavelength of 0.4–0.7 micrometers, medium wavelength infrared (MWIR) having a wavelength of 3–5 micrometers, or long wavelength infrared (LWIR) radiation having a wavelength of 8–12 micrometers. In infrared systems especially, the photodetector array is cooled to reduce parasitic thermal noise and increase the sensitivity. The photodetector array and associated cooling apparatus are mounted in an evacuated chamber or "dewar", which occupies a relatively large portion of the extremely limited space available in a missile tracking system or the like.

In various applications, it is desirable to obtain two simultaneous images of a scene in different optical wavelength bands, such as the visible band and one of the infrared bands. In a missile system, this enables daytime tracking using the visible image, and nighttime tracking using the infrared image. It may also be desirable to obtain simultaneous MWIR and LWIR images.

"Two-color" or "dual-image" scanning systems have been constructed which include a beamsplitter to split the optical image from a telescope into two branches, and a separate photodetector array and appropriate optical bandpass filter in each branch. A system of this type is disclosed in "Conceptual Design of the High-Resolution Imaging Spectrometer (HIRIS) for EOS", by M. Herring, in Proceedings of SPIE—The International Society of Optical Engineering, Remote Sensing, Apr. 3–4, 1986, Orlando, Fla., Vol. 644, pp. 82–85. However, such a system is too large for an application such as a missile tracker since a separate dewar is required for each photodetector array, and the optical paths for the two branches from the beamsplitter occupy an unacceptably large amount of space. In addition, the optical system requires precision alignment, which greatly increases the cost and reduces the reliability of the apparatus. Additional systems have been constructed which can image in two or more spectral bands by mechanically and sequentially inserting different spectral bands into an optical path. This approach, however, can lead to lower sensitivity and provides sequential rather than simultaneous dual band images.

It is also desirable in certain applications to obtain two simultaneous images of a scene or target respectively orthogonal polarizations. A compact optical imaging system for providing this function has not been available.

SUMMARY OF THE INVENTION

In accordance with the present invention, one or more double-refracting or birefringent prisms are disposed in front of the entrance aperture of a Cassegrain-type telescope which constitutes the optical focussing assembly in a tracking system for a guided missile or the like. The prism refracts first radiation having a first polarization in a first direction, and refracts second radiation having a second polarization which is orthogonal to the first polarization in a second direction which is deviated from the first direction by a predetermined angle $\Delta\phi$.

The telescope focusses the first and second radiation to form separate, laterally displaced first and second optical images on first and second respective sections of a focal plane photodetector array. Polarizing filters which pass only the first and second polarizations therethrough are disposed in front of the respective sections of the photodetector array to eliminate optical crosstalk between the two images.

Optical bandpass filters having different wavelength passbands may also be provided in front of the two sections of the photodetector array such that the two images constitute different color images of the scene. The two images may include, for example, a visible image and an infrared image.

The present optical imaging apparatus requires only one focal plane array, which can be accommodated in a single dewar. In addition, the optical path of the present apparatus does not occupy significantly more space than in a comparable prior art imaging apparatus which produces only a single image. The present invention provides the following specific advantages over the prior art.

1. Highly compact and efficient in utilization of available space.

2. Enables simultaneous imaging in two optical wavelength bands using one focal plane photodetector array.

3. Does not represent a significant increase in complexity over a single image system.

4. Provides two simultaneous optical images of a scene or target having two respective orthogonal polarizations.

These and other features and advantages of the present invention will be apparent to those skilled in the art from the following detailed description, taken together with the accompanying drawings, in which like reference numerals refer to like parts.

DESCRIPTION OF THE DRAWINGS

FIG. 1 is a simplified diagram illustrating a guided missile including a tracking system incorporating a dual-image optical imaging apparatus embodying the present invention;

FIG. 2 is a simplified sectional view illustrating the present imaging apparatus;

FIG. 5 is a diagram illustrating an alternative birefringent prism arrangement of the present apparatus;

FIG. 6 is a diagram illustrating another alternative birefringent prism arrangement of the present apparatus.

DETAILED DESCRIPTION OF THE INVENTION

Figure 3:
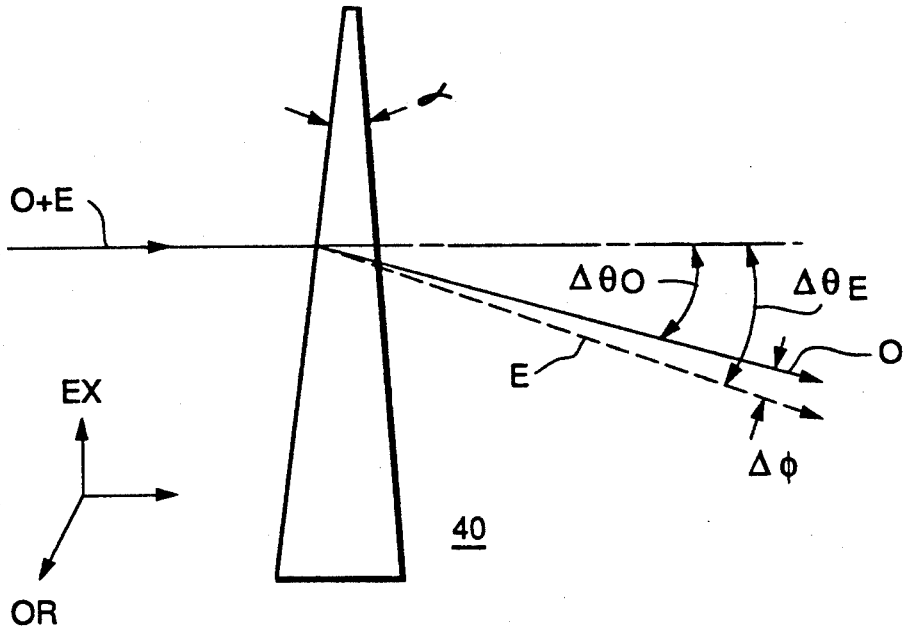
FIG. 3 is a diagram illustrating the operation of a birefringent prism of the present apparatus.

As illustrated in FIG. 1, a guided missile 10 embodying the present invention includes an airframe 12 in which is mounted a dual-image optical imaging apparatus 14. The apparatus 14 produces two separate optical images of a scene or target 16 such as a tank having respectively orthogonal polarizations and feeds electronic images corresponding to the optical images to a tracking system 18.

A guidance system 20 receives electronic signals from the tracking system 18 indicating the difference between the trajectory of the missile 10 and a line-of-sight or axis 22 to the target 16, and feeds control signals to movable aerodynamic control surfaces such as fins 24 to cause the missile 10 to move toward the axis 22.

As illustrated in FIG. 2, the imaging apparatus 14 includes a Cassegrain-type telescope 26 having an angular field-of-view on the order of 4°. Optical radiation from the target 16 is incident on the apparatus 14 along the axis 22, which is also the optical axis of the telescope 26. The telescope 26 includes a concave first mirror 28, a convex second mirror 30, and a relay lens system symbolically illustrated as a converging lens 32 which focusses non-inverted optical images of the target 16 through a central hole 28*a* in the mirror 28 onto a focal plane photodetector array 34.

Although the telescope 26 is described and shown as being of the Cassegrain type, it will be understood that the present invention may be practiced using other types of optical focussing apparatus such as refracting telescopes, although not specifically illustrated.

In accordance with the present invention, a double-refracting or birefringent prism 36 is disposed closely adjacent to an entrance aperture 26*a* of the telescope 26. The prism 36 has a wedge or triangular cross-section, which is tapered in the direction of an axis 38 which perpendicularly intersects the axis 22. The prism 36 extends perpendicular to a plane 40 defined by the axes 22 and 38 (the plane of FIG. 2) so as to cover the entrance aperture 26*a*.

Referring also to FIG. 3, the birefringent prism 36 is fabricated of a material such as lithium niobate ($LiNbO_3$) or thallium arsenic selenide ($Tl_3AsSe_3$) such that its extraordinary or optic axis EX is parallel to the axis 38, and its ordinary axis OR is perpendicular to axes 38 and 22. Radiation incident on the apparatus 14 from the scene or target 16 includes the spectrum of natural electromagnetic radiation, including first radiation O which is polarized parallel to the ordinary axis OR, and second radiation E which is polarized parallel to the extraordinary axis EX.

Using the generalized thin prism approximation for the refraction or angular deflection $\Delta\theta$ an incident light ray through a prism, $\Delta\theta=(\eta-1)\ \alpha$, where $\alpha$ is the prism angle and $\eta$ is the index of refraction of the prism material. The deflection $\Delta\theta_E$ of the second radiation E using this approximation is $\Delta\theta_E=(\eta_E-1)\ \alpha$, where $\eta_E$ is the extraordinary index of refraction of the birefringent material. The deflection $\Delta\theta_O$ of the first radiation O is $\Delta\theta_O=(\eta_O-1)\ \alpha$, where $\eta_O$ is the ordinary index of refraction of the birefringent material. The differential deflection or deviation angle $\Delta\phi$, or the angle between the first and second radiation O and E, is $\Delta\phi=(\eta_E-\eta_O)\ \alpha$.

Figure 4:
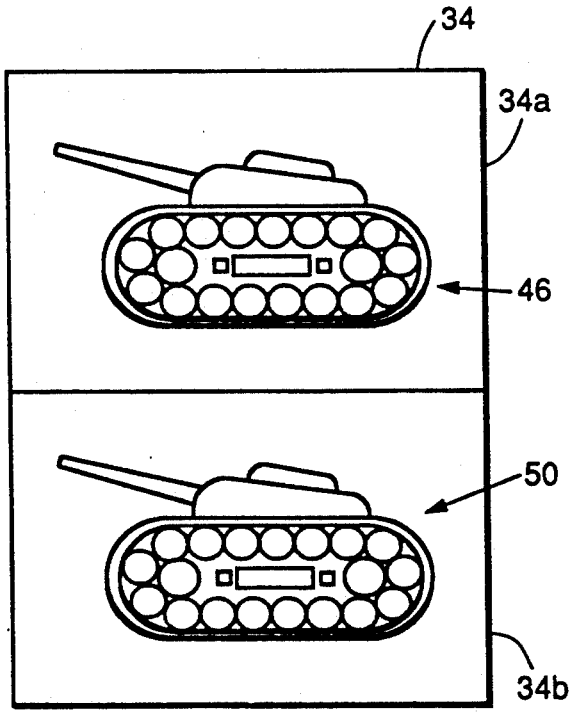
FIG. 4 is a diagram illustrating separate optical images having two respectively orthogonal polarizations as focussed on a focal plane photodetector array by the present apparatus.

The birefringent prism 36 thereby separates or splits the incident radiation into two images constituted by the first radiation O and the second radiation E which are deviated from each other by the angle $\Delta\phi$. As illustrated in FIG. 4, the telescope 26 focusses a first optical image 46 constituted by the first radiation O onto an upper or first section 34*a* of the array 34 in a focal plane 48 which coincides with the light receiving surface of the array 34. The telescope 26 further focusses a second optical image 50 constituted by the second radiation E onto a lower or second section 34*b* of the array 34 in the focal plane 48. The second image 50 is laterally displaced downwardly from the first image 46 by a distance determined by the angle $\Delta\phi$. The displacement or deviation angle $\Delta\phi$ is selected to be approximately one-half the field-of-view of the telescope 26, in this case $\Delta\phi=4°/2=2°$.

Typically, the array 34 is a rectangular focal plane photodetector array consisting of 256×256 photodetector elements (not shown). In this case, the angle $\Delta\phi$ is selected such that the second image 50 will be displaced downwardly from the first image 46 by a distance corresponding to 256/2=128 elements. In this manner, the first image 46 is focussed on the first section 34*a* of the array 34, whereas the second image 50 is focussed on the second section 34*b* of the array 34, with each image 46 and 50 being 128 elements high and 256 elements wide.

Where the telescope 26 has a circularly symmetrical optical configuration, each image 46 and 50 will have an initial size corresponding to 256×256 elements. The lower 128×256 half (not shown) of the image 50 is focussed in the focal plane 48 below the array 34, and is not used. However, the undesired lower 128×256 half (not shown) of the image 46 overlaps the desired upper 128×256 half of the image 50.

In order to prevent the overlapping lower half of the image 46 from reaching the lower section 34*b* of the array 34, an optical polarizing filter 52 is provided in front of the section 34*b* which transmits the second radiation E therethrough, but blocks the first radiation O. In order to prevent any peripheral portion of the second image 50 from reaching the first section 34a of the array 34, another optical polarizing filter 54 is provided in front of the section 34a which transmits the first radiation O therethrough, but blocks the second radiation E. The polarizing filters 52 and 54 prevent optical cross-talk between the two images, and ensure that the first and second images 46 and 50 consist of only the first radiation O and the second radiation E respectively.

In addition to providing two separate optical images 46 and 50 consisting of the first and second radiation O and E which are polarized parallel to the ordinary and extraordinary axes OR and EX of the prism 36 respectively, it is further within the scope of the present invention to provide optical bandpass filters 56 and 58 in front of the first and second sections 34a and 34b as shown. The filters 56 and 58 transmit radiation therethrough in different spectral wavelength bands, such as visible and infrared respectively, and block all other radiation. This enables the present apparatus 14 to operate as a "dual-band" or "dual-color" optical imaging apparatus, providing simultaneous images in two different regions of the optical spectrum. The scope of the present invention is not limited to operation in any specific wavelength bands, and the bands selected for use will vary in accordance with a particular application.

The focal plane array 34, polarizing filters 52 and 54 and bandpass filters 56 and 58 are mounted in a single dewar 60. The array 34 generates electronic image signals which are fed to the tracking system 18 for guidance of the missile 10.

The first and second sections 34a and 34b may be 128×256 portions of an integral focal plane array. Alternatively, the first and second sections 34a and 34b may be different types of 128×256 focal plane photodetector arrays which are mounted adjacent to each other in the focal plane 48 as illustrated. The size and type of the array 34 are not the particular subject matter of the present invention, and are selected in accordance with a particular application. For example, a charge-coupled-device (CCD) photodetector array is suitable for visible light, whereas a mercury-cadmium-telluride (HgCdTe) based array is suitable for infrared radiation.

To obtain two simultaneous images in orthogonal polarization in a typical application, the prism 36 will be fabricated of $LiNbO_3$, which has an ordinary index of refraction $\eta_O=2.095$ and an extraordinary index of refraction $\eta_E=2.16$ at a wavelength of 3.0 micrometers in the MWIR band. The quantity $(\eta_E-\eta_O)=0.065$. $\Delta\phi=2°=0.035$ radians. The required prism angle is thereby $\alpha=0.035/0.065=0.538$ radians$=30.1°$.

For $Tl_3AsSe_3$ at a wavelength of 9.6 micrometers, $\eta_O=3.339$, $\eta_E=3.152$, and the quantity $(\eta_E-\eta_O)=0.187$. The required prism angle is thereby $\alpha=0.035/0.187=0.187$ radians$=10.7°$.

If dual color imagery is to be obtained, the values of the indices of refraction to be used are those appropriate to the different wavelengths, i.e., $\Delta\phi=[\eta_E(\lambda_1)-\eta_O(\lambda_2)]\alpha$ where $\lambda_1$ and $\lambda_2$ are the two different wavelengths.

Various advantages can be achieved by replacing the single prism 36 with a combination of two or more birefringent prisms. FIG. 5 illustrates an arrangement of two birefringent prisms 62 and 64 having conjugate, right triangular cross-sections in the plane 40. The prism 62 has a perpendicular face 62a which faces the scene 16, and an inclined face 62b which faces the array 34. The prism 64 has an inverted shape relative to the prism 62, including a perpendicular face 64a which faces the array 34 and an inclined face 64b which faces the scene 16 and mates with the face 62b of the prism 62. The inclined surfaces 62b and 64b may be pressed together, cemented together, or separated by an air gap.

The extraordinary axis EX of the prism 62 extends parallel to the axis 38, and the ordinary axis OR of the prism 62 extends perpendicular to the axes 38 and 22 in the same manner as with the prism 36. The prism 64 is oriented such that the ordinary axis OR is parallel to the axis 38 and the extraordinary axis EX is perpendicular to the aces 38 and 22. This is accomplished by fabricating the prism 64 such that the ordinary axis OR' thereof extends parallel to the axis 38, and the extraordinary axis EX' thereof extends perpendicular to the axes 38 and 22. This has the effect of deflecting the first radiation O by $-\Delta\phi$, and causing the second radiation E to be deviated by $\Delta\phi$. An additional benefit of this arrangement is that any dispersion of the radiation O and E will be canceled and the relative deflection of the extraordinary array with respect to the ordinary ray is $2\Delta\phi$.

It is further within the scope of the present invention to obtain a larger displacement or deviation angle $\Delta\phi$ by providing several pairs of prisms 62 and 64 in longitudinal alignment with each other as illustrated in FIG. 6. Each additional pair of prisms 62 and 64 deflects the rays by $2\Delta\phi$ degrees.

While several illustrative embodiments of the invention have been shown and described, numerous variations and alternate embodiments will occur to those skilled in the art, without departing from the spirit and scope of the invention.

Figure 7:
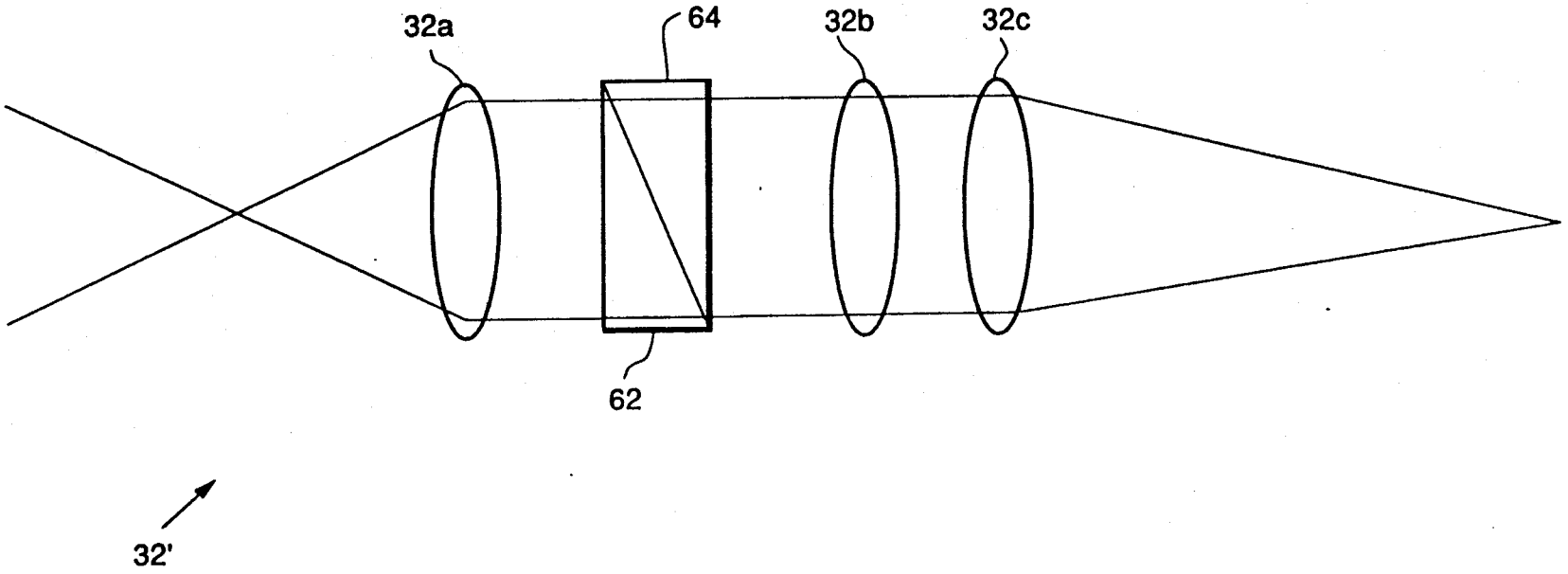
FIG. 7 is a diagram illustrating an alternative positional arrangement of the present birefringent prism.

For example, although the prism 36 is described and illustrated as being located at the entrance aperture 26a of the telescope 26, the prism 36 may alternatively be located at another position in the apparatus 14 at which the optical image is collimated, such as between individual lenses 32a and 32b of a converging lens system 32' which further includes a lens 32c as shown in FIG. 7.

In addition, although the ordinary axis OR of the prism 36 has been described and shown as extending perpendicular to the axes 38 and 22, the axis OR may extend parallel to the axis 38, or at any other angle of inclination relative to the plane 40.

Accordingly, it is intended that the present invention not be limited solely to the specifically described illustrative embodiments. Various modifications are contemplated and can be made without departing from the spirit and scope of the invention as defined by the appended claims.

I claim:

1. An optical imaging apparatus for producing first and second optical images of a scene including first and second electromagnetic radiation having first and second orthogonal polarizations respectively received from the scene, comprising:

a birefringent prism which refracts the first radiation therethrough in a first direction and refracts the second radiation therethrough in a second direction which is deviated from the first direction by a predetermined angle; and optical means for focussing the first and second radiation at a focal plane to produce the first and second optical images respectively;

said predetermined angle being selected such that the first and second optical images are laterally displaced from each other by a predetermined distance in the focal plane.

2. An imaging apparatus as in claim 1, in which:

the first and second radiation are incident on the prism along a first axis;

the prism has a triangular cross-section in a plane defined by the first axis and a second axis which perpendicularly intersects the first axis, the prism extending perpendicular to said plane; and the prism has an ordinary axis which is parallel to the first axis, and an extraordinary axis which is perpendicular to the first axis.

3. An imaging apparatus as in claim 2, in which the ordinary axis of the prism is parallel to the second axis.

4. An imaging apparatus as in claim 2, in which the prism has a right triangular cross-section in said plane.

5. An imaging apparatus as in claim 2, in which the prism has an isosceles triangular cross-section in said plane.

6. An imaging apparatus as in claim 2, further comprising a second birefringent prism disposed adjacent to said prism, the second prism having an ordinary axis which is parallel to the first axis and an extraordinary axis which is perpendicular to the first axis.

7. An imaging apparatus as in claim 6, in which the extraordinary axis of the second prism is parallel to the ordinary axis of the first prism.

8. An imaging apparatus as in claim 6, in which the second prism has a triangular cross-section in said plane which is conjugate to said cross-section of said prism, and extends perpendicular to said plane.

9. An imaging apparatus as in claim 8, in which:

said prism has a right triangular cross-section including a perpendicular face which faces the scene and an inclined face which faces the focal plane; and the second prism has a right triangular cross-section which is inverted relative to said prism, including a perpendicular face which faces the focal plane and an inclined face which faces the scene and mates with the inclined face of said prism.

10. An imaging apparatus as in claim 1, further comprising optoelectronic sensor means disposed in the focal plane for producing electrical signals corresponding to the first and second optical images.

11. An imaging apparatus as in claim 10, in which the sensor means comprises an optoelectronic focal plane photodetector array.

12. An imaging apparatus as in claim 10, in which:

the sensor means has a first section on which the first optical image is incident and a second section on which the second optical image is incident; and the imaging apparatus further comprises:

first polarizing means disposed between the optical means and the first section of the sensor means for transmitting the first radiation having the first polarization therethrough and blocking the second radiation having the second polarization; and second polarizing means disposed between the optical means and the second section of the sensor means for transmitting the second radiation having the second polarization therethrough and blocking the first radiation having the first polarization.

13. An imaging apparatus as in claim 12, further comprising:

first optical filter means disposed between the optical means and the first section of the sensor means for transmitting only a first optical wavelength band therethrough; and second optical filter means disposed between the optical means and the second section of the sensor means for transmitting only a second optical wavelength band therethrough which is different from the first optical wavelength band.

14. An imaging apparatus as in claim 1, in which the optical means is disposed between the prism and the focal plane.

15. An imaging apparatus as in claim 14, in which:

the optical means has an entrance aperture; and the prism is disposed closely adjacent to the entrance aperture.

16. An imaging apparatus as in claim 15, in which the optical means comprises a Cassegrain-type telescope.

17. An imaging apparatus as in claim 1, in which the prism is disposed in a collimated image area of the optical means.

18. An imaging apparatus as in claim 1, in which:

the optical means has a predetermined angular field-of-view; and said predetermined angle is approximately one-half said field-of-view.

19. In a guided missile, a tracking system including an optical imaging apparatus for producing first and second optical images of a scene including first and second electromagnetic radiation having first and second orthogonal polarizations respectively received from the target, comprising:

a birefringent prism which refracts the first radiation therethrough in a first direction and refracts the second radiation therethrough in a second direction which is deviated from the first direction by a predetermined angle; and optical means for focussing the first and second radiation at a focal plane to produce the first and second optical images respectively;

said predetermined angle being selected such that the first and second optical images are laterally displaced from each other by a predetermined distance in the focal plane.

20. A guided missile as in claim 19, in which:

the first and second radiation are incident on the prism along a first axis;

the prism has a triangular cross-section in a plane defined by the first axis and a second axis which perpendicularly intersects the first axis, the prism extending perpendicular to said plane; and the prism has an ordinary axis which is parallel to the first axis, and an extraordinary axis which is perpendicular to the first axis.

21. A guided missile as in claim 20, in which the ordinary axis of the prism is parallel to the second axis.

22. A guided missile as in claim 20, in which the prism has a right triangular cross-section in said plane.

23. A guided missile as in claim 20, in which the prism has an isosceles triangular cross-section in said plane.

24. A guided missile as in claim 20, further comprising a second birefringent prism disposed adjacent to said prism, the second prism having an ordinary axis which is parallel to the first axis and an extraordinary axis which is perpendicular to the first axis.

25. A guided missile as in claim 24, in which the extraordinary axis of the second prism is parallel to the ordinary axis of the first prism.

26. A guided missile as in claim 24, in which the second prism has a triangular cross-section in said plane which is conjugate to said cross-section of said prism, and extends perpendicular to said plane.

27. A guided missile as in claim 26, in which:

said prism has a right triangular cross-section including a perpendicular face which faces the target and an inclined face which faces the focal plane; and the second prism has a right triangular cross-section which is inverted relative to said prism, including a perpendicular face which faces the focal plane and an inclined face which faces the target and mates with the inclined face of said prism.

28. A guided missile as in claim 19, further comprising optoelectronic sensor means disposed in the focal plane for producing electrical signals corresponding to the first and second optical images.

29. A guided missile as in claim 28, in which the sensor means comprises an optoelectronic focal plane photodetector array.

30. A guided missile as in claim 28, in which:

the sensor means has a first section on which the first optical image is incident and a second section on which the second optical image is incident; and the imaging apparatus further comprises:

first polarizing means disposed between the optical means and the first section of the sensor means for transmitting the first radiation having the first polarization therethrough and blocking the second radiation having the second polarization; and second polarizing means disposed between the optical means and the second section of the sensor means for transmitting the second radiation having the second polarization therethrough and blocking the first radiation having the first polarization.

31. A guided missile as in claim 30, further comprising:

first optical filter means disposed between the optical means and the first section of the sensor means for transmitting only a first optical wavelength band therethrough; and second optical filter means disposed between the optical means and the second section of the sensor means for transmitting only a second optical wavelength band therethrough which is different from the first optical wavelength band.

32. A guided missile as in claim 19, in which the optical means is disposed between the prism and the focal plane.

33. A guided missile as in claim 32, in which:

the optical means has an entrance aperture; and the prism is disposed closely adjacent to the entrance aperture.

34. A guided missile as in claim 33, in which the optical means comprises a Cassegrain-type telescope.

35. A guided missile as in claim 19, in which the prism is disposed in a collimated image area of the optical means.

36. A guided missile as in claim 19, in which:

the optical means has a predetermined angular field-of-view; and said predetermined angle is approximately one-half said field-of-view.

* * * * *